US008844437B2

(12) United States Patent
Baggot et al.

(10) Patent No.: US 8,844,437 B2
(45) Date of Patent: Sep. 30, 2014

(54) PROCESS AND SYSTEM FOR ALIGNING PRINTED IMAGES WITH PERFORATED SHEETS

(75) Inventors: James L. Baggot, Menasha, WI (US); Timothy A. Wooley, Sherwood, WI (US); Justen H. Smith, Martinez, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1156 days.

(21) Appl. No.: 11/796,614

(22) Filed: Apr. 27, 2007

(65) Prior Publication Data

US 2008/0264280 A1 Oct. 30, 2008

(51) Int. Cl.

| | |
|---|---|
| ***B41K 3/12*** | (2006.01) |
| ***B41F 13/12*** | (2006.01) |
| ***B41G 7/00*** | (2006.01) |

(52) U.S. Cl.

CPC ..... *B41F 13/12* (2013.01); *B41G 7/006* (2013.01); *B41P 2217/52* (2013.01)

USPC ..... 101/35; 101/226

(58) Field of Classification Search

USPC ..... 101/248, 226, 35, 36

See application file for complete search history.

(56) References Cited

U.S. PATENT DOCUMENTS

| | | | | |
|---|---|---|---|---|
| 3,264,921 | A | 8/1966 | Nystrand | |
| 3,832,064 | A * | 8/1974 | Horst et al. | 356/634 |
| 4,361,260 | A | 11/1982 | Hanlan | |
| 4,757,930 | A | 7/1988 | Ditto | |
| 4,781,090 | A | 11/1988 | Feldkamper et al. | |
| 4,896,605 | A | 1/1990 | Schroder | |
| 4,955,265 | A | 9/1990 | Nakagawa et al. | |
| 5,119,725 | A | 6/1992 | Okamura | |
| 5,263,413 | A * | 11/1993 | Ikeguchi | 101/183 |
| 5,417,638 | A | 5/1995 | Anderson et al. | |
| 5,452,632 | A | 9/1995 | Durr et al. | |
| 5,660,674 | A | 8/1997 | Saindon et al. | |
| 5,720,223 | A | 2/1998 | Meschi | |
| 5,802,974 | A | 9/1998 | McNeil | |
| 5,839,688 | A | 11/1998 | Hertel et al. | |
| 6,273,313 | B1 | 8/2001 | Noll et al. | |
| 6,928,929 | B1 | 8/2005 | McNeil | |
| 6,929,838 | B1 | 8/2005 | McNeil | |
| 6,983,686 | B2 | 1/2006 | Vaughn et al. | |
| 7,037,575 | B2 | 5/2006 | Forry et al. | |
| 7,089,854 | B2 | 8/2006 | McNeil | |
| 2003/0234305 | A1 * | 12/2003 | Cole | 242/160.1 |
| 2004/0003521 | A1 * | 1/2004 | Penn et al. | 40/299.01 |
| 2004/0258887 | A1 | 12/2004 | Maciag et al. | |

(Continued)

FOREIGN PATENT DOCUMENTS

| | | | |
|---|---|---|---|
| EP | 1527898 | A1 | 5/2005 |

*Primary Examiner* — David Banh

(74) *Attorney, Agent, or Firm* — Dority & Manning, P.A.

(57) ABSTRACT

A system and process for aligning printed images on a rolled product with perforation lines being formed into the product is disclosed. According to the process, the position of printed images are sensed as the images are being printed onto a substrate, such as a tissue strip. The images are printed onto the substrate using a printing device including at least one rotating print roller. In order to maintain the printed images in alignment with perforation lines being formed into the substrate, the speed of the print roller is adjusted in order to adjust the length of the printed images.

12 Claims, 2 Drawing Sheets

(56) References Cited

U.S. PATENT DOCUMENTS

2005/0034578 A1* 2/2005 Brandenburg et al. ..... 83/13
2005/0153100 A1 7/2005 Zöller et al.
2005/0204941 A1* 9/2005 McNeil ..... 101/226
2007/0084099 A1* 4/2007 Sarbo et al. ..... 40/674
2007/0239126 A1* 10/2007 Wilson et al. ..... 604/385.01
2008/0148981 A1* 6/2008 Brandenburg et al. ..... 101/485

* cited by examiner

PROCESS AND SYSTEM FOR ALIGNING PRINTED IMAGES WITH PERFORATED SHEETS

BACKGROUND OF THE INVENTION

One of the many challenges that exist during the training of a child to use a toilet is teaching the child to use an appropriate amount of bath tissue. In situations where a child uses more bath tissue than actually needed, not only is there waste of the excess bath tissue, but also the excess bath tissue can create a mess within the bathroom, potentially even clogging the toilet or related plumbing. Furthermore, any mess or clogs resulting from the use of excess bath tissue could frustrate the child and discourage his or her progress in the training.

The difficulties with children learning to use the appropriate length of bath tissue can be associated with the difficulty that children can have in determining both an appropriate amount and the sheet count of the bath tissue. For example, the child may not intuitively know what amount of bath tissue is appropriate to use without a visual cue or other pattern on the bath tissue.

To help the child during the training process, a parent or other teacher may instruct the child to use a certain amount of bath tissue. Typically, a parent would instruct or suggest an amount of bath tissue to use, measured by the sheet count of the bath tissue. For example, if a parent instructs the child to use 3 or 4 sheets, it may be difficult for the child to determine and count 3 or 4 sheets. This difficulty can be created by the difficulty is seeing the perforations separating the sheets of bath tissue. Also, very young children may have difficulty in counting to 3 or 4, especially with the added pressure of the toilet training process.

Many previous rolled tissue products have incorporated designs or pictures on the base web. These designs are typically directed to making the tissue product more aesthetically pleasing to a child, or even to an adult. Some designs may even be directed to a side benefit of helping to teach a child the alphabet or numbers.

Problems have been experienced, however, in the ability to register the designs or pictures on the rolled products with the perforations that separate the individual sheets. In particular, a need exists for a manufacturing process and system capable of registering or aligning a printed image with perforation lines formed into a continuous strip of tissue paper. Specifically, a need exists for aligning printed images with perforation lines on a tissue paper without having to alter the distance between adjacent perforation lines.

SUMMARY OF THE INVENTION

In general, the present disclosure is directed to a system and process for aligning printed images with perforated sheets on a continuous sheet of tissue paper. In one embodiment, for instance, the process includes the steps of printing images onto a moving tissue strip using a print roller. The print roller rotates at a speed relative to the speed of the tissue strip. The print roller rotates in the same direction as the tissue strip is moving. At least one feature of the printed images is then sensed for determining the location of the printed images.

Perforation lines are formed into the moving tissue strip to form individual sheets along the strip having a sheet length. The perforation lines are formed across the tissue strip in a direction perpendicular to the direction in which the tissue strip is moving. The perforation lines are formed at regular intervals so as to maintain a constant sheet length.

In accordance with the present disclosure, based upon the position of the sensed feature of the printed images relative to the perforation lines being formed, the speed of the print roller is adjusted in order to adjust the length of the images so as to align the images with the perforation lines in a desired manner.

For instance, in one embodiment, the images may be printed onto the tissue strip in a pattern. The printed pattern may have a repeat length. The at least one feature that is sensed in the printed images may be, for instance, the length of the repeat length. In accordance with the present disclosure, by adjusting the speed of the print roller relative to the web speed, the repeat length of the printed images can be similarly adjusted so that at least certain of the images fall within adjacent perforation lines.

In one embodiment, the printed pattern may include registration marks that are sensed by an optical sensor. The registration marks may be located within the printed pattern for indicating the length of the repeat length.

In general, any suitable printing device including a print roller can be incorporated into the process and system of the present disclosure. In one embodiment, for instance, the tissue strip is conveyed around a rotating drum that rotates at substantially the same speed at which the tissue strip is moving. One or more print rollers can be located adjacent to the drum for printing the images onto the tissue strip as the strip is rotated around the drum. In one embodiment, a plurality of print rollers may be used. The print rollers, for instance, can cooperate together to form the printed images. For example, each print roller may print a separate color for creating the images. In this embodiment, the rotational speed of each of the print rollers can be adjusted in order to adjust length of the printed images. In particular, the print rollers can be adjusted independently to maintain color to color registration as desired. Alternatively, the print rollers may be adjusted together in synchronicity so as to maintain the print rollers in registration during formation of the printed images and to maintain a consistent length.

The system of the present disclosure for carrying out the process can include a printing device comprising a rotating print roller and a sensor located downstream of the printing device for sensing a feature on images that are being printed onto the moving tissue strip. A perforation device is included that forms perforation lines into the moving tissue strip to form individual sheets. In accordance with the present disclosure, the system further includes a controller, such as a microprocessor, in communication with the sensor and the print roller. Based on information received from the sensor, the controller is configured to adjust the speed of the print roller in order to adjust the length of the printed images so as to maintain at least certain of the images in alignment with the perforation lines.

As described above, in one embodiment, the printing device may include a plurality of print rollers. Each of the print rollers can be in communication with the controller. The controller can be configured to control the rotational speed of each of the print rollers independently of the others. By controlling the rotational speed of the print rollers relative to the speed of the web, the size of the printed images can be varied.

In one embodiment, the system can further include a tension adjusting device for controlling the tension of the tissue strip being conveyed through the printing device. Controlling the tension of the tissue strip within the printing device allows for better control of the size of the printed images.

In one embodiment, the one or more print rolls can have a circumference that substantially matches a fixed number of individual tissue sheets. For instance, the circumference of the one or more print rollers may substantially match the length of four sheets, five sheets, or six sheets. Alternatively, the circumference of the print rollers may substantially match the length of eight sheets, nine sheets, ten sheets, eleven sheets, or twelve sheets. Having the circumference of the print roller substantially match a fixed number of individual tissue sheets facilitates maintaining the printed image in alignment with the perforation lines. In addition finer control can be exercised by optimizing the cylinder diameter to compensate for repeat length changes between the tension zones being measured by the sensors. This also reduces the speed and distance of a correction resulting in less stress on the web and less distortion of the printed image in the machine direction.

Other features and aspects of the present disclosure are discussed in greater detail below.

BRIEF DESCRIPTION OF THE DRAWINGS

A full and enabling disclosure of the present invention, including the best mode thereof to one of ordinary skill in the art, is set forth more particularly in the specification, including reference to the accompanying Figures in which.

Figure 1:
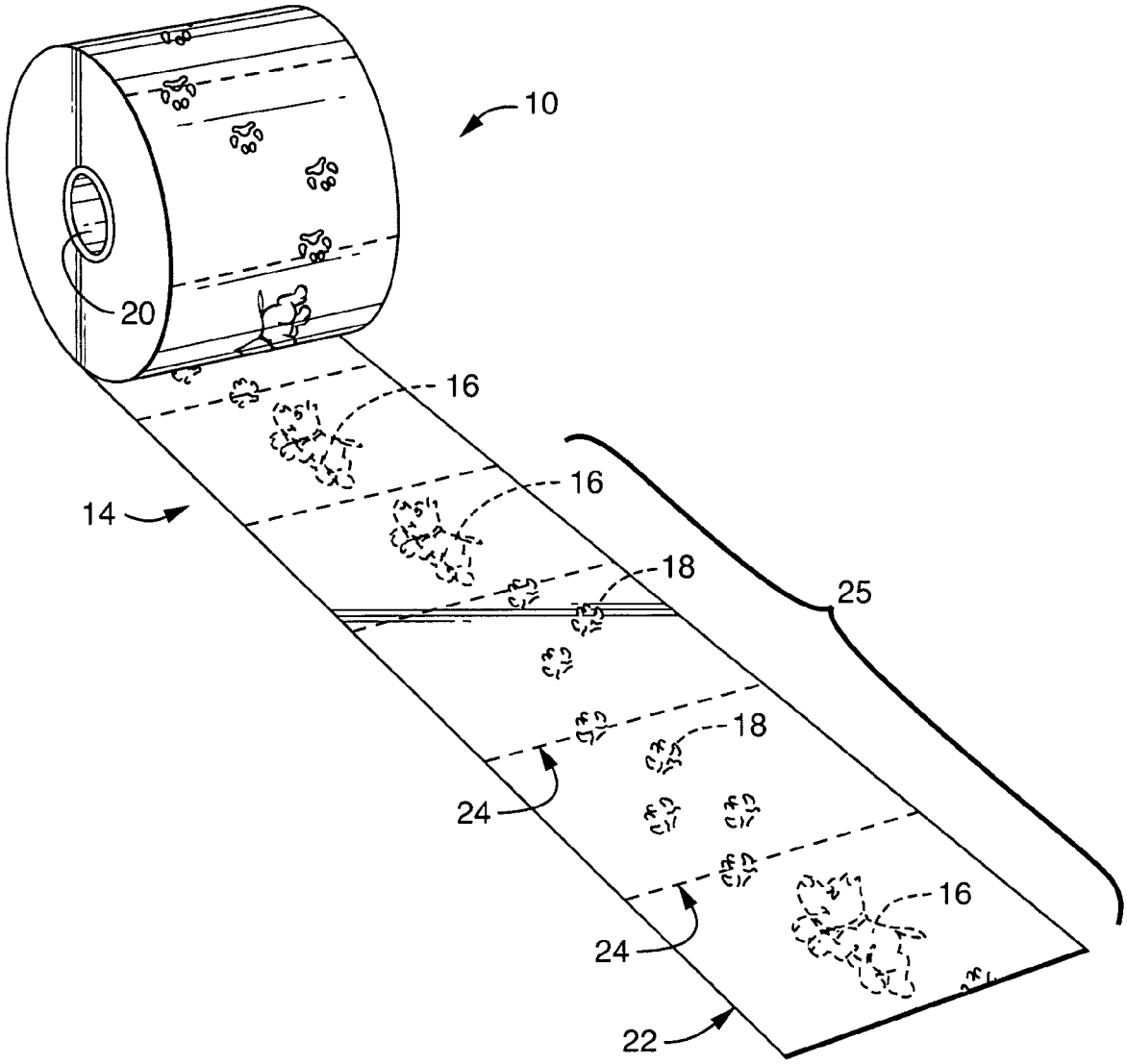
FIG. 1 is one embodiment of a rolled tissue product that may be made in accordance with the present disclosure.

Repeat use of reference characters in the present specification and drawings is intended to represent the same or analogous features or elements of the present invention.

DETAILED DESCRIPTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in the invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied in the exemplary constructions.

In general, the present disclosure is directed to printing images on rolled tissue products such as bath tissues, paper towels, and the like. The rolled tissue product, for instance, may comprise a tissue web that has been spirally wound onto a core. Alternatively, the rolled product may be coreless. According to the present disclosure, various images are printed onto at least one side of the tissue web. The images can be printed onto the tissue web in a pattern. In general, any suitable image can be printed onto the tissue web in accordance with the present disclosure.

For example, in one embodiment, images are printed onto the tissue strip in order to help a user distinguish a predetermined length of the tissue product. For instance, if the tissue product comprises bath tissue, the printed pattern may indicate an appropriate amount of the tissue strip that should be used by a child during a toilet training process.

The pattern or design applied to the tissue sheet can be aesthetically appealing to help calm and encourage a child during the toilet training process. For example, the pattern or design can have characters that are easily recognizable by a child such as cartoon-like characters or geometric shapes. Additionally, the pattern can comprise alphanumeric characters such as numbers and/or letters to help supplement the child's development and learning processes. For example, the images printed onto the tissue sheet can comprise a pattern or design of consecutive alphanumeric characters that help the child learn the alphabet or learn how to count.

In an alternative embodiment, the images printed onto the tissue sheet may be provided purely for aesthetic reasons. For instance, the images may comprise a design or pattern that may match the décor of the room in which the product is to be used.

The present disclosure is particularly directed to a process and system for printing the images onto the tissue sheet so that the images stay in alignment during the printing process. For instance, the process of the present disclosure can be used to align images with perforation lines that are formed into the tissue sheet. More particularly, as will be described in more detail below, the images are maintained in alignment with perforation lines by adjusting the length of the images as they are printed onto the tissue sheet.

Of particular advantage, the process and system of the present disclosure allow for alignment of the printed images with the perforation lines without having to alter the spacing of the perforation lines. Thus, the printed pattern can remain in alignment with the perforation lines without having to change the individual sheet length of the rolled product. A consistent sheet length in the finished product may be desired since any variation in sheet length can increase the cost of the product to produce.

In one embodiment, for instance, the images printed onto the tissue sheet include registration marks. The registration marks, for instance, may be located on one or both edges of the sheet. The registration marks can be sensed with a sensor in close proximity to a perforation device that is configured to form perforation lines into the moving tissue sheet. Once the registration marks are sensed, the system can be configured to compare the position of the printed images in relation to the location of the perforation lines to determine registration coordination. In order to control registration, the speed of the printing device can be changed relative to the speed of the moving tissue sheet. In this manner, the length of the images being printed onto the sheet can be made longer or shorter and thus change the position of the registration marks relative to the perforation lines being formed into the tissue sheet. By knowing the tissue sheet path length and the system geometry, the printing device can be adjusted, coordinated, or homed to match-up the printed images with perforation lines being formed.

Referring to FIG. 1, for exemplary purposes only, a rolled tissue product 10 that may be made in accordance with the present disclosure is shown. In this embodiment, the rolled tissue product 10 comprises bath tissue. It should be understood, however, that any sheet-like product may be made in accordance with the present disclosure.

As shown in FIG. 1, a pattern of images is located on a tissue strip 14. In this embodiment, the pattern of images comprises a repeating pattern of puppies 16 and paw prints 18. In this embodiment, the images are only visible from a first surface of the tissue strip 14. In other embodiments, however, the images can be applied to both surfaces of the tissue strip 14 as desired.

As shown, the tissue sheet is spirally wound to form a roll 20. The roll 20 is formed from the tissue strip 14 that has been divided into individual tissue sheets 22 by a series of perforation lines 24. As shown in FIG. 1, the individual tissue sheets 22 have a rectangular shape. The length of the tissue sheets 22 can vary depending upon the product. For bath tissues such as shown in FIG. 1, for instance, the length of each sheet may be from about 3.75 inches to about 4.25 inches. For paper towels, longer sheets lengths are usually employed.

In one embodiment, the images printed onto the tissue strip 14 can be oriented to help a child determine a predetermined distance of the strip, such as the distance covering an appropriate amount of bath tissue that a child should use. The appropriate amount of bath tissue can vary depending upon various factors. In one embodiment, an appropriate amount of bath tissue can be from about 8 inches to about 24 inches of the tissue strip 14. For example, the typical amount of standard bath tissue can be from about 8 inches to about 20 inches, such as from about 12 inches to about 16 inches during use.

Measuring the bath tissue quickly can involve counting the number of tissue sheets 22 as the roll 20 is unwound. For example, an appropriate amount of bath tissue can be two or more tissue sheets. In some embodiments, for instance, the appropriate amount of bath tissue to be used for wiping can be from about two sheets to about five sheets, such as from about three sheets to about four sheets.

As shown in FIG. 1, in this embodiment, the image printed on the tissue strip 14 comprises puppies 16 separated by paw prints 18. The two puppies and the paw prints in between make up a repeating pattern 25 having a repeat length. As shown in FIG. 1, the repeating pattern extends over a distance of five tissue sheets 22 that can be, for instance, 4.09" in length. It should be understood, however, than in other embodiments, the repeat length of the pattern may extend over more or less tissue sheets as desired.

When attempting to teach a child how much bath tissue to use during wiping, the child can be instructed to tear the bath tissue along the perforation lines that separate the repeat length of the pattern. In FIG. 1, for instance, a child can be taught to tear the tissue strip 14 after unwinding the tissue role to locate the second puppy 16. In an alternative embodiment, the repeat pattern may only include a single puppy 16. In this embodiment, a child can be taught to tear the tissue strip prior to or after the next puppy instead of in between two adjacent puppies. It should be understood that in addition to the images illustrated in FIG. 1, any suitable printing pattern may be applied to the tissue sheet. For instance, in other embodiments, alphanumeric characters may be used that have a desired repeat length.

The present disclosure is directed to a system and process for printing the images onto the tissue strip in a manner so that at least certain of the images remain in alignment with the perforation lines as desired. In FIG. 1, for instance, the puppies 16 are printed onto the tissue strip 14 so that the puppies remain in between adjacent perforation lines. The paw prints 18, on the other hand, are not in registration or coordinated with the perforation lines. In other embodiments, however, a pattern may be used in which all the images may be coordinated with the perforation lines as desired.

Figure 2:
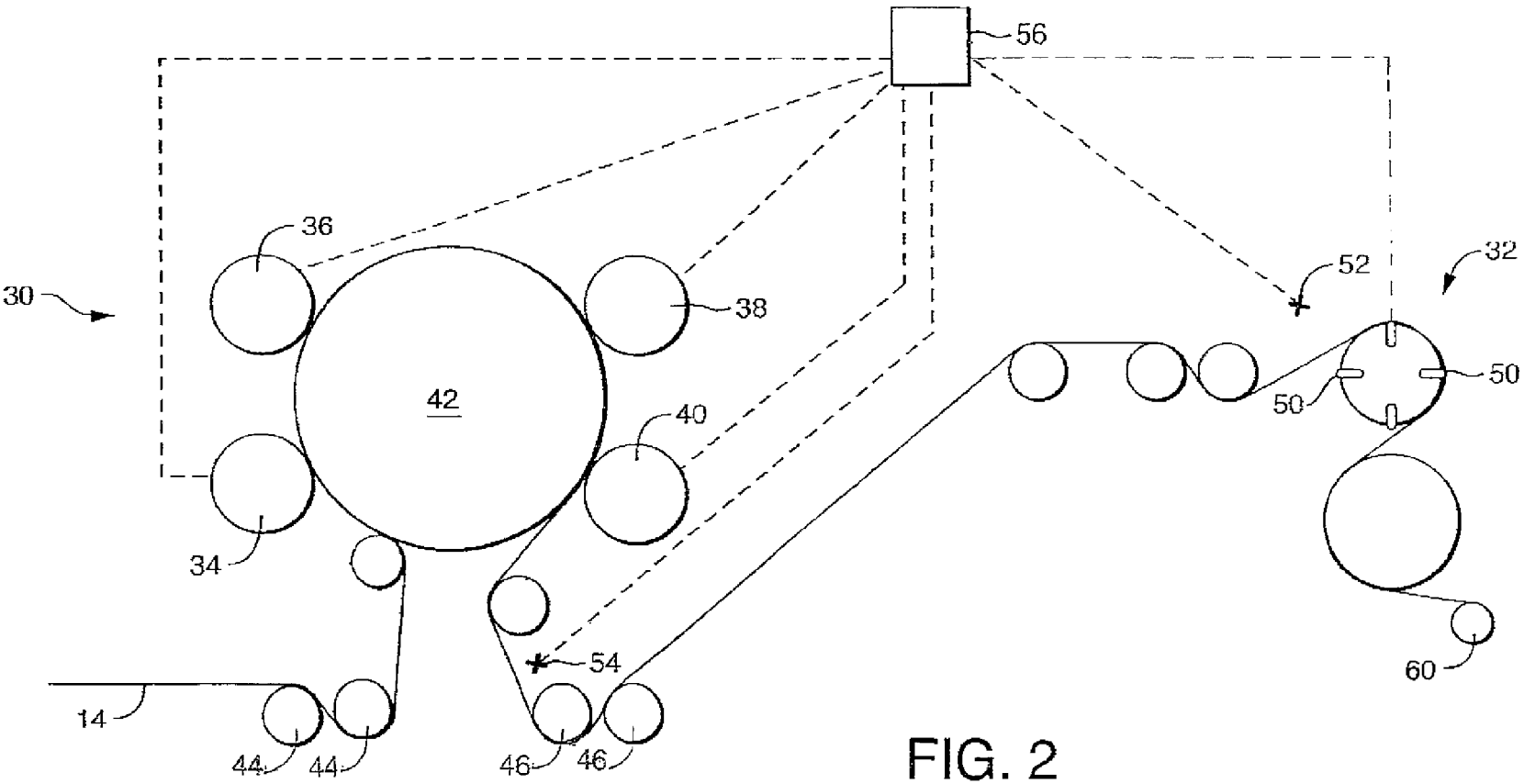
FIG. 2 is a schematic diagram of one embodiment of a system made in accordance with the present disclosure.

Referring to FIG. 2, one embodiment of a system that may be used in order to align printed images with perforation lines is illustrated. As shown, the system includes a printing device 30 located downstream from a perforation device 32. The tissue strip 14 is fed into the system for printing images onto the tissue sheet and for perforating the strip into individual tissue sheets simultaneously and in coordination. The system illustrated in FIG. 2 can be an online process or can be an offline process. For instance, in an offline process, the tissue strip 14 may be fed into the system from a parent roll.

In the embodiment illustrated in FIG. 2, the printing device 30 comprises at least one print roller 34. For example, in the embodiment shown in FIG. 2, the printing device 30 includes four different print rollers 34, 36, 38 and 40. As shown, the print rollers 34, 36, 38 and 40 are placed adjacent to a rotating drum 42. The tissue strip 14 travels along the surface of the rotating drum 42 in between the drum and the print rollers 34, 36, 38 and 40.

During operation, the rotating drum 42 rotates in the same direction as the tissue strip is moving. The rotating drum 42 also travels at a speed that is substantially the same speed at which the tissue strip is moving. In this manner, the rotating drum 42 does not affect the tension in the tissue strip as the tissue strip is conveyed downstream.

The print rollers 34, 36, 38 and 40 rotate into contact with the tissue strip 14 for printing images onto the tissue strip. The print rollers, for instance, may cooperate together in order to form the printed images. For instance, in one embodiment, each print roller may be configured to apply a different color to the tissue strip as it is conveyed for forming the images. In an alternative embodiment, each print roller may be configured to apply a different image to the tissue strip.

In order to apply an ink to the tissue strip, each print roller 34, 36, 38 and 40 may comprise, for instance, a flexographic printing roll. For instance, each print roller may include an elastomeric sleeve that has been molded or otherwise designed to include a pattern. As the print roller rotates, the print roller may directly contact an ink that is contained, for instance, in a bath, for applying the ink to the tissue strip according to the pattern that is formed into the elastomeric sleeve. In an alternative embodiment, offset printing may be used in which an ink bath is first contacted with a pickup or anilox roller that then in turn contacts a print roller for applying an ink to the print roller that is then transferred to the tissue strip.

In one embodiment, the printing device 30 may be configured such that all of the print rollers 34, 36, 38 and 40 move in tandem and at the same speed. In an alternative embodiment, however, a gearless printing device may be used in which the speed of each print roller may be controlled independently of the other print rollers. Independent control of each print roller may provide various advantages in particular applications. For instance, as will be described in greater detail below, independent control of each print roller may provide better control over the size of the image being printed onto the tissue strip 14.

As shown in FIG. 2, the system further includes at least one in-feed roll 44 and at least one out-feed draw roll 46 that help guide the tissue strip 14 around the rotating drum 42. In addition to help guiding the tissue strip around the rotating drum 42, the in-feed roll(s) 44 and the out-feed draw roll(s) 46 can also be used to influence the tension of the tissue strip as it is conveyed around the rotating drum and in contact with the printing device. Maintaining uniform and constant tension on the tissue strip 14 as it is conveyed around the rotating drum provides a more stable substrate for contact with the print rollers during the printing process. Maintaining uniform tension in the tissue strip also allows for better control of the images being printed onto the strip.

In order to control the tension of the tissue strip 14 as it is conveyed around the rotating drum 42, for instance, the speed ratio between the in-feed draw roll(s) 44 and/or the out-feed draw roll(s) 46 can be adjusted as may be measured by roll(s) 46. In this manner, the amount of tension applied to the tissue strip can be varied. For example, adjusting the speed of outfeed draw rolls 46 in relation to the speed of the infeed draw rolls 44 may increase or decrease tension on the tissue strip.

It should be understood, however, that any suitable tension control device may be employed in the system shown in FIG. 2. For instance, in other embodiments, a dancer roll or other similar device may be incorporated into the system for maintaining the tissue strip under constant and uniform tension.

As described above, the images that are printed onto the tissue strip 14 may include a repeating pattern. After the images are printed onto the tissue strip, the strip is then conveyed in contact with the perforation device 32. In the embodiment illustrated in FIG. 2, for instance, the perforation device 32 comprises a rotating drum that includes a plurality of perforation blades 50 and a perforator head with a set of stationary anvils. The perforation blades 50 contact the moving tissue strip 14 and stationary anvils to form perforation lines in a direction perpendicular to the length of the strip. The perforation lines formed into the tissue strip are formed at regular intervals forming individual tissue sheets along the strip. According to the present disclosure, all of the tissue sheets formed into the tissue strip have a uniform length.

It should be understood, that the perforation device 32 illustrated in FIG. 2 represents merely one embodiment of a device configured to form perforations in the tissue strip. It should be understood, that any suitable perforation device may be used. One embodiment of a perforation device that may be used in the present disclosure, for instance, is disclosed in U.S. Pat. No. 3,264,921, which is incorporated herein by reference.

In accordance with the present disclosure, the system illustrated in FIG. 2 further includes a first sensor 52, a second sensor 54, and a controller 56. The sensors 52 and 54 in conjunction with the controller 56 are used to monitor and adjust the size of the images being printed on the tissue strip 14 for making sure that a least certain of the images remain in alignment and are coordinated with the perforation lines being formed into the strip by the perforation device 32.

For instance, the first sensor 52 may be configured to sense the position of the images being printed on the tissue strip 14. In general, any suitable sensor may be used that is capable of monitoring the position of an image. The first sensor 52, for instance, may be very sophisticated and monitor the entire image as it is conveyed on the tissue strip or maybe a less complex device that only senses a particular feature within the images. In one embodiment, for instance, the first sensor 52 may comprise a MICRODOT camera commercially available from Hurletron.

In one particular embodiment, for instance, the print rollers 34, 36, 38 and 40 may be configured to incorporate registration marks into the images being printed onto the tissue strip. The first sensor 52 may be configured to sense the registration marks for determining the size and position of the printed images in relation to the perforation lines being formed into the tissue strip by the perforation device 32. For instance, by sensing the registration marks, the first sensor may be configured to determine the repeat length of the pattern of the printed images. As shown in FIG. 2, this information can then be communicated to a controller 56. The controller 56, for instance, may comprise any suitable programmable device, such as a microprocessor. In addition to being in communication with the first sensor 52, the controller 56 can also be in communication with each of the print rollers 34, 36, 38 and 40. In addition, if desired, the controller can also be in communication with the perforation device 32. The perforation device 32, for instance, may incorporate or be in communication with a position sensing device, such as an encoder, in order to compare the position of the printed pattern with the position of the perforation blades or to otherwise monitor the location of the perforation blades.

The controller 56 can be configured, for instance, to adjust the speed of one or more print rollers based upon the information received from the first sensor 52. By adjusting the speed of the print rollers, the size of the images or the repeat length of the pattern can be varied for ensuring that the printed images remain in alignment with the perforation lines being formed into the tissue strip. For example, slowing the rotational speed of the print rollers in relation to the speed of the moving tissue strip will elongate the printed images. Increasing the speed of the print rollers, on the other hand, in relation to the speed of the moving tissue strip will cause the printed images to become shorter in length. When adjusting the length of the printed images, the controller 56 can vary the speed of a single print roller, a plurality of the print rollers, or all of the print rollers. Further, the controller 56 can be configured to control the speed of each of the print rollers independently of the other rollers, especially when using a gearless printing device.

The amount of variation in the length of the printed images using the process of the present disclosure can vary depending upon the particular application. In general, for instance, the repeat length of the printed images may be varied by at least 1%, such as at least 2%, such as up to about 5% or even greater. The amount that the printed images can be varied in length may depend, for instance, on the size of the images, the speed of the tissue strip and the type of design being printed onto the strip. For instance, it may be more difficult to adjust the length of more complicated designs whereas relatively simple designs or abstract shapes may be more amendable to length variations.

As shown in FIG. 2, the first sensor 52 is positioned adjacent to the perforation device 32. It is believed that greater precision in aligning the printed images with the perforation lines can be obtained if the images are being monitored in close proximity to the perforation device. For instance, in one embodiment, the first sensor 52 can be configured to sense at least one feature of the printed images within about 10 feet of the perforation device, such as within about 5 feet of the perforation device, such as within about 2 feet of the perforation device.

As shown in FIG. 2, the system may optionally include the second sensor 54 in addition to the first sensor 52. The second sensor 54 can also be configured to sense at least one feature of the images being printed onto the tissue strip 14. For instance, the second sensor 54 may be configured to sense the repeat length of the pattern being printed onto the tissue strip while the tissue strip is still under tension. As shown, the second sensor 54 can also be placed in communication with the controller 56. The controller 56 can then use the information received from the first sensor 52 and the second sensor 54 to monitor the position of the printed images.

In one embodiment, for instance, the sensors 52 and 54 can be used to observe or determine the impact of web tension and/or web property changes adjacent to the printing device in comparison to the changes in web tension or other properties prior to the perforation device with respect to the position of the printed images. This information collected from the sensors may be used for making adjustments in winding or cut-off of the web. This information can also be trended over time to profile a parent roll population for making plate roll diameter adjustments that will better match plate roll diameter to finished printing repeat.

In one embodiment, in order to better control the alignment between the printed images and the perforation lines, each of the print rollers 34, 36, 38 and 40 can have a circumference that coincides with the length of the individual tissue sheets being formed within the tissue strip. For instance, the circumference of each print roller can substantially match the length of a fixed number of individual tissue sheets. For example, in one embodiment, the circumference of the print rollers can match the length of four tissue sheets, five tissue sheets, six tissue sheets, and the like. Matching the circumference of the print rollers with the length of the tissue sheets being formed allows for the print rollers to run at a speed substantially similar to the speed at which the tissue sheet is moving. In this manner, the print rollers do not adversely impact upon the tension of the tissue strip as it is conveyed downstream. In addition, the impact of any speed difference between the print rollers and the tissue strip is minimized. Ultimately, the size of the printed image can be varied while minimizing distortion of the printed image.

As shown in FIG. 2, after the perforation lines are formed into the tissue strip using the perforation device 32, the tissue strip 14 is wound into a roll 60. In one embodiment, the process can be configured to form final products having a particular sheet count. In an alternative embodiment, the roll 60 can be collected and later unwound for forming individual rolled products later.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for aligning printed images with perforated sheets on a continuous sheet of tissue paper comprising:

printing images onto a moving tissue strip using a print roller, the print roller rotating at a speed relative to a speed of the moving tissue strip, the print roller rotating in the same direction as the tissue strip is moving, the images having a length along the direction of the moving tissue strip;

sensing at least one feature of the printed images;

forming perforation lines into the moving tissue strip to form individual sheets along the strip having a uniform sheet length, the perforation lines being formed across the tissue strip in a direction perpendicular to the direction in which the tissue strip is moving, the perforation lines being formed at regular, constant intervals so as to maintain a uniform sheet length for the individual sheets formed along the length of the tissue strip;

based upon the position of the sensed feature relative to the perforation lines being formed, adjusting the speed of the print roller in order to adjust the length of the images so as to align the images with the perforation lines in a desired manner;

wherein the images are printed in a pattern into the moving tissue strip, the printed pattern having a repeat length wherein the length of the repeat length is sensed and is greater than or equal to the length of multiple sheets and the repeat length extends over multiple individual sheets; and wherein the printed pattern depicts a scene that extends continuously across multiple individual sheets and includes at least one of the images being a first image disposed entirely within the perforation lines and at least one of the images being a second image, distinct from the first image, and traversing over at least one of the perforation lines.

2. A process as defined in claim 1, wherein the printed pattern includes registration marks that are sensed, the registration marks indicating the length of the repeat length.

3. A process as defined in claim 1, wherein the tissue strip is conveyed around a rotating drum, the drum rotating at substantially the same speed at which the tissue strip is moving, the print roller printing the images onto the tissue strip as the strip is rotated around the drum.

4. A process as defined in claim 1, wherein the images are printed onto the tissue strip using a plurality of print rollers, the print rollers cooperating together to form the printed images, the rotational speed of each of the print rollers being adjusted in order to adjust the length of the printed images.

5. A process as defined in claim 4, wherein the speed of each of the print rollers can be adjusted independent of the other print rollers.

6. A process as defined in claim 1, wherein the print roller circumference substantially matches the length of a fixed number of individual tissue sheets.

7. A process as defined in claim 6, wherein the circumference of the print roller substantially matches the length of from about four sheets to about twelve sheets.

8. A process as defined in claim 1, further comprising the step of controlling the tension of the tissue strip when the strip is in contact with the print roller.

9. A process as defined in claim 1, wherein the tissue strip is conveyed around a rotating drum, the drum rotating at substantially the same speed as the moving tissue strip, the printed images being printed onto the tissue strip using a plurality of print rollers, each of the print rollers being placed adjacent to the rotating drum for printing the images onto the tissue strip while the strip is being conveyed on the drum, each of the print rollers cooperating together to form the printed images, the rotational speed of each of the print rollers being controlled independently of the other print rollers.

10. A process as defined in claim 1, wherein the length of the images is adjusted so as to maintain certain of the images in between adjacent perforation lines.

11. A process as defined in claim 1, wherein the at least one feature of the printed images is sensed in close proximity to where the perforation lines are being formed.

12. A process as defined in claim 11, wherein the at least one feature of the printed images is sensed within about four feet of where the perforation lines is being formed.

* * * * *